United States Patent [19]

Munks

[11] Patent Number: 4,767,099

[45] Date of Patent: Aug. 30, 1988

[54] HOIST SYSTEM

[76] Inventor: R. Leonard Munks, 1141 W. March Point Rd., Anacortes, Wash. 98221

[21] Appl. No.: 50,689

[22] Filed: May 18, 1987

[51] Int. Cl.[4] ..... B66D 1/36; A61D 3/00

[52] U.S. Cl. ..... 254/336; 119/102; 254/338; 254/369

[58] Field of Search ..... 254/334, 335, 336, 337, 254/369; 119/100, 101, 102

[56] References Cited

U.S. PATENT DOCUMENTS

| | | | |
|---|---|---|---|
| 1,179,115 | 4/1916 | La Vake | 254/337 |
| 4,306,707 | 2/1981 | Roscoe | 254/4 R |
| 4,432,306 | 2/1984 | Rossa | 119/100 |
| 4,550,686 | 11/1985 | Munks | 119/102 |
| 4,600,177 | 7/1986 | Fritz | 254/338 |

FOREIGN PATENT DOCUMENTS

| | | | |
|---|---|---|---|
| 321594 | 9/1902 | France | 119/102 |
| 687408 | 2/1953 | United Kingdom | 119/102 |

*Primary Examiner*—Stuart S. Levy

*Assistant Examiner*—Katherine Matecki

*Attorney, Agent, or Firm*—Kolisch, Hartwell & Dickinson

[57] ABSTRACT

The hoist system of the instant invention is intended for use with an overhead support and includes an elongate bar disposed below the overhead support and extending in a generally horizontal direction. A lifting device is attached adjacent opposed ends of the bar for connecting the bar to the object to be lifted. At least one intermediate pulley is attached to an upper side of the bar intermediate the ends thereof. A fastening mechanism cooperating with the overhead support for affixing the system to the support is provided which includes a downwardly extending pulley. A winch mechanism is mounted on the bar and includes at least cable having one end thereof affixed to the bar and trained, serially, over the fastening mechanism pulley and under the intermediate pulley while the other end of the cable is secured to the winch mechanism. The winch mechanism is operable to lift the bar and the object connected thereto.

3 Claims, 3 Drawing Sheets

HOIST SYSTEM

BACKGROUND OF THE INVENTION

1. Field of the Invention

This invention relates generally to lifting apparatus and more particularly to a self-contained hoist which may be used in confined areas.

2. Description of the Prior Art

Lifting devices of the general type described herein incorporate a winch drum having a cable attached thereto and some form of drum break to prevent rotation of the drum when a load is applied to the cable. One example of such a mechanism is disclosed in U.S. Pat. No. 4,600,177 to Fritz.

Another lifting mechanism is shown in U.S. Pat. No. 4,306,707 to Roscoe, Jr. This reference discloses one technique for supporting an object at two places by a lifting mechanism having a single drum.

Another form of lifting device is the well known come-along. A come-along is a useful device for lifting or pulling an object, however, it provides only a single attachment point at either end of the device. The use of a come-along to lift objects which must be maintained substantially horizontally requires the use of more than one come-along. Such a use is shown in my issued U.S. Pat. No. 4,550,686 in connection with an animal sling for use in rehabilitating down or injured livestock. As depicted, a pair of come-alongs are required in order to maintain the animal in a proper orientation. This of course requires two overhead support points. The arrangement also requires that the two come-alongs be operated somewhat synchronously to avoid undue stress on the animal. A fairly high overhead clearance is required to allow the animal tender room to move about, particularly when moving from the location of one come-along to that of the other come-along.

The object of the instant invention is to provide a hoist which will lift at multiple points and which requires only a single overhead support point.

Another object of the instant invention is to provide a hoist which will operate in minimal overhead clearance.

A further object of the invention is to provide a hoist which will enable a single person to lift a large object.

Yet another object of the instant invention is to provide a hoist which is inexpensive, easy to use and which is effective for its intended purpose.

SUMMARY OF THE INVENTION

The hoist system of the instant invention is intended for use with an overhead support and includes an elongate bar disposed below the overhead support and extending in a generally horizontal direction. A lifting device is attached adjacent opposed ends of the bar for connecting the bar to the object to be lifted. At least one intermediate pulley is attached to an upper side of the bar intermediate the ends thereof. A fastening mechanism cooperating with the overhead support for affixing the system to the support is provided which includes a downwardly extending pulley. A winch mechanism is mounted on the bar and includes at least cable having one end thereof affixed to the bar and trained, serially, over the fastening mechanism pulley and under the intermediate pulley while the other end of the cable is secured to the winch mechanism. The winch mechanism is operable to lift the bar and the object connected thereto.

These and other objects and advantages of the invention will become more fully apparent as the description which follows is read in conjunction with the drawings.

DETAILED DESCRIPTION OF THE PREFERRED EMBODIMENTS

First Embodiment

Figure 1:
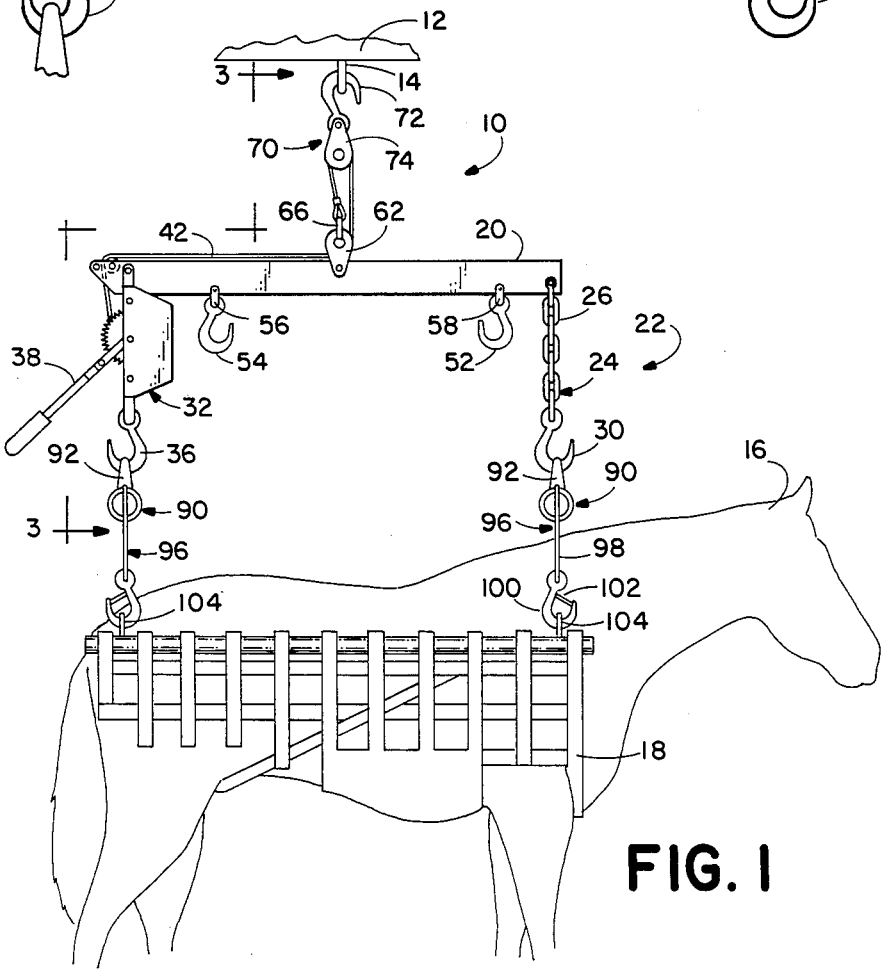
FIG. 1 is a side view of the hoist of the invention which has been shown attached to an animal sling having an animal therein.

Turning now to the drawings, and initially to FIG. 1, the hoist system of the invention is shown generally at 10. System 10 is depicted as being attached to an overhead support 12 having an eye 14 secured thereto and lifting an animal 16 carried in an animal sling, shown generally at 18.

Figure 2:
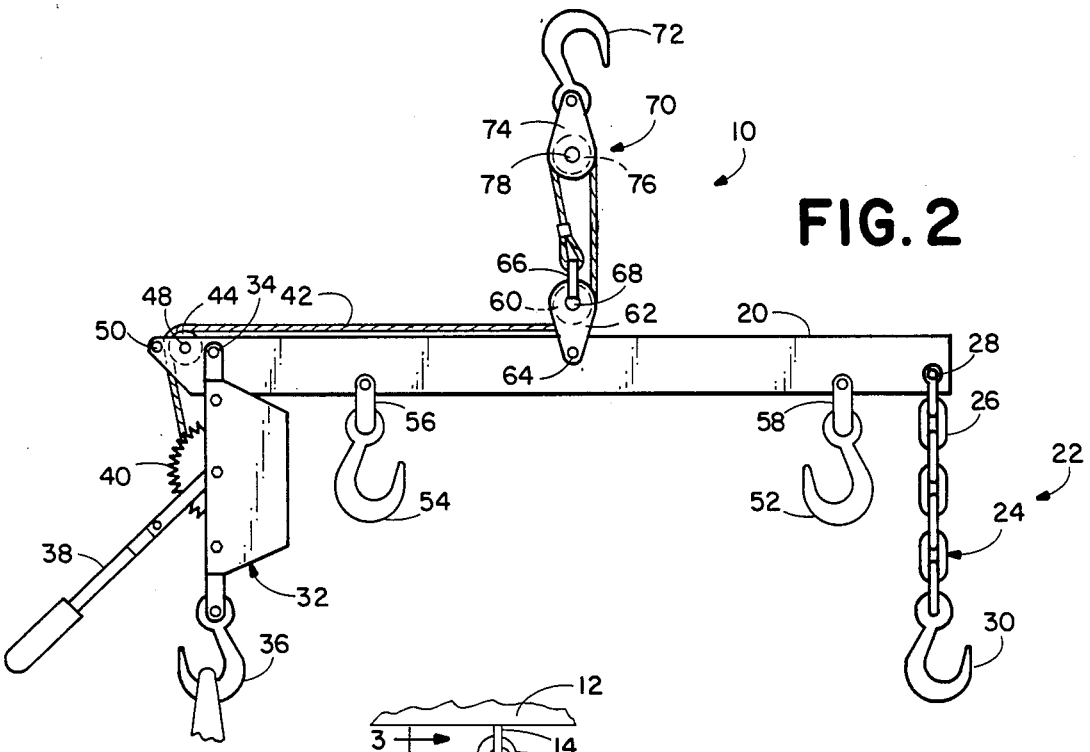
FIG. 2 is a side plan view of one embodiment of the instant invention.
Figure 3:
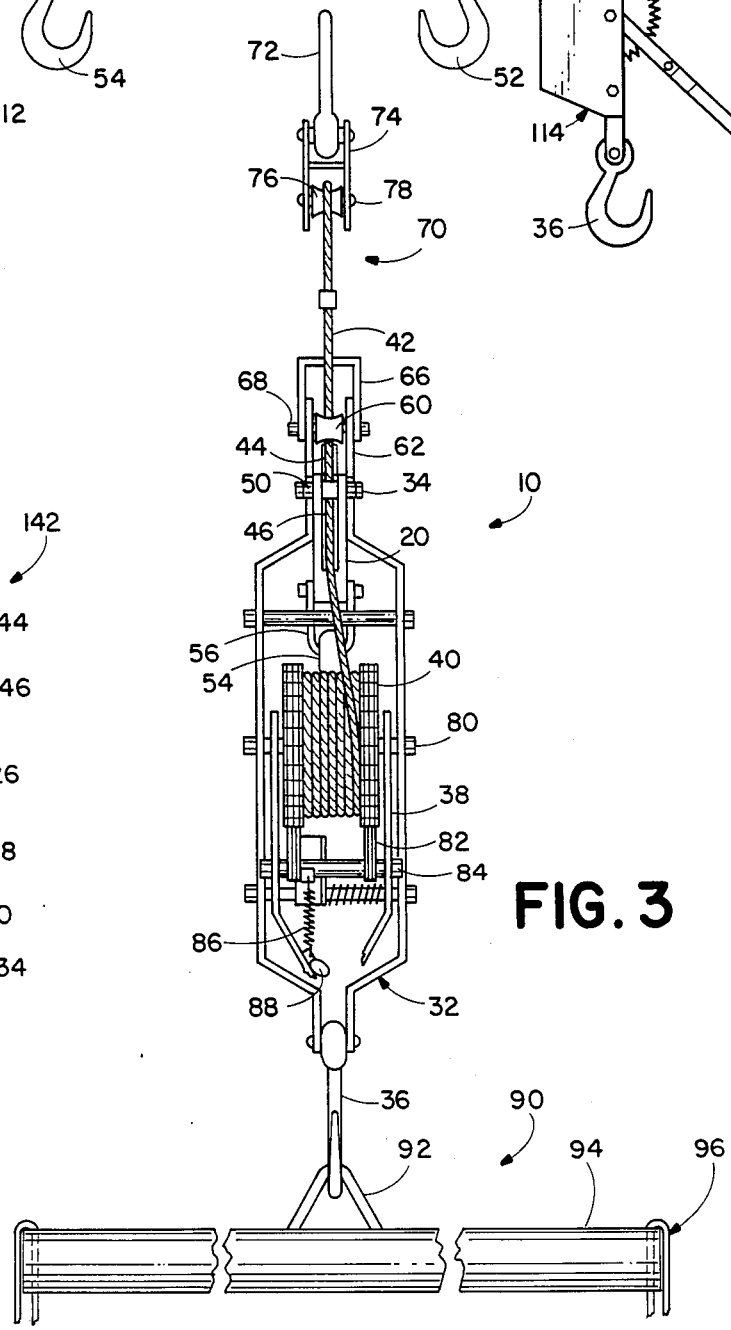
FIG. 3 is an end view of the hoist, taken generally along the line 3—3 of FIG. 1.

Referring now to FIGS. 1, 2 and 3, system 10 will be further explained in detail. Hoist system 10 includes an elongate bar 20 and lifting means, shown generally at 22. Lifting means are attached adjacent opposed ends of the bar for connecting the bar to the object to be lifted. In this embodiment of the invention, lifting, or connecting, means 24 includes a length of chain 26 which is attached to bar 20 by a pin or bolt 28 and which has a hook 30 attached to the free end thereof.

The lifting means at the other end of bar 20, in this embodiment, includes a winch mechanism 32 which is mounted adjacent to the other end of bar 20 by a pin 34 and which has a hook 36 attached to the free end thereof. The winch mechanism is operated by a handle or lever 38 which drives a drum 40 having ratchet engaging teeth about the periphery thereof. A cable 42 is wound on drum 40 and extends over a terminal pulley 44 which is rotatably mounted on bar 20 by a pin 48. Cable 42 is held in place over pulley 44 by a keeper pin 50 in a slot 46.

Lifting means further include a pair of hooks 52, 54 which are attached directly to bar 20 by means of clevises 56, 58, respectively. Hooks 52, 54 are intended for use in low-overhead situations. Their use will be described further later herein.

An intermediate pulley 60 is attached to bar 20 by means of a pulley housing 62 and a intermediate pulley securing pin 64 intermediate ends of the bar.

A strap 66 is secured to pulley housing 62 by a bolt 68 which also rotatably mounts intermediate pulley 60 inside of housing 62. Strap 66, also referred to herein as cable attachment means, is provided to secure the free end of cable 42, which is formed into a loop.

Fastening means, shown generally at 70 are provided to affix the system to overhead support 12. Fastening means 70 includes a hook 72 which is secured to a fastening means pulley housing 74. Housing 74 includes a fastening means pulley 76 rotatably mounted therein on pin 78.

Turning now to FIG. 3, the come-along of the device is shown in greater detail. As previously noted, the come-along includes a drum 40 which has ratchet-engaging-teeth about the periphery of the drum ends. The drum is rotatably mounted on a axle 80. A pawl 82 is swingably mounted on a bolt 84 mounted on lever 38. The pawl is held in a fixed position by a spring 86 which is fixed to a swingable attachment point 88. Attachment point 88 may be positioned to shift pawl 82 to cause drum 40 to either reel in or pay out cable, thereby raising or lowering bar 20 relative to overhead support 12.

Cable 42 is trained, serially, over terminal pulley 44, under intermediate pulley 60, over fastening means pulley 76 and secured to cable attachment means 66. This provides a block and tackle arrangement of the form which is known as a gun tackle purchase, which provides a mechanical advantage of 2, thereby enabling the user to lift twice as much weight as the come-along, by itself, would be able to lift.

Referring now to FIGS. 1 and 3, one technique for connecting system 10 to sling 18 is shown. System 10 is connected to sling, or sling means 18 by what are referred to as cross member means, shown generally at 90. Cross member means 90 includes an eye 92 which attach to hook 30 or 36, and which is secured to a tubular cross piece 94 having a sling connector 96 at either end thereof. In the preferred embodiment connectors 96 include a strap 98 which has one end thereof secured to cross piece 94 and has a hook 100 with a spring catch 102 secured to the other end thereof.

Sling 18 has hoist connectors 104 which take the form of eyebolts, which cooperate with hooks 88 for securing the hoist system to the sling.

This technique enables an animal to be lifted from a single support point, represented by eye 14.

Figure 6:
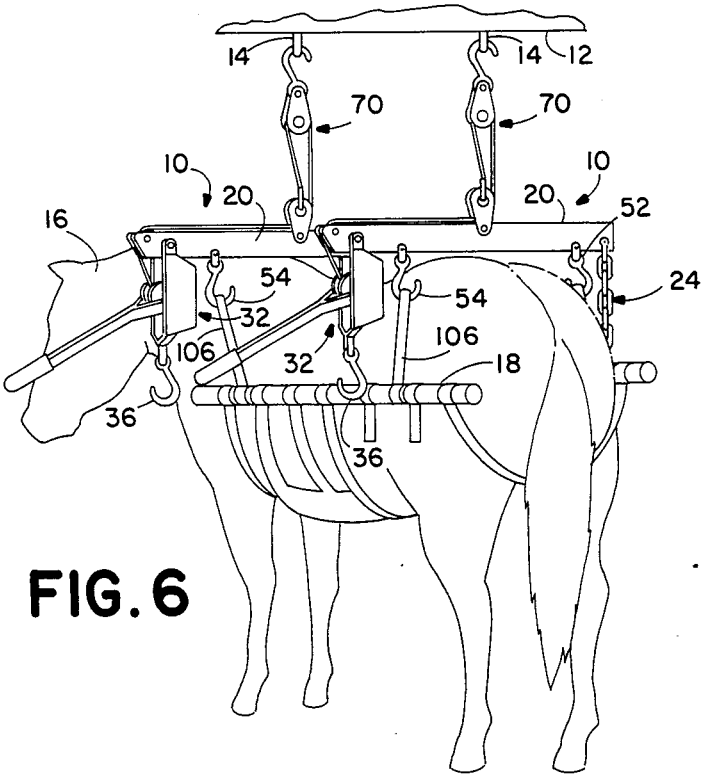
FIG. 6 is a perspective view depicting use of the invention in a low-overhead situation.

Referring now to FIG. 6, a pair of hoist systems 10 are shown connected to a pair of overhead support points 14 and a sling 18 with an animal 16 therein. This technique would be used in the case of an extremely low-overhead situation. Cross member means 90 are not used in this configuration. Depending on the size of the animal, hooks 52, 54 may be directly connected to hoist connectors 104 on the sling, or, as depicted to FIG. 6, extension straps 106 may be applied to the sling and connected to hooks 52, 54. This enables an animal handler to rehabilitate a downed animal, which may stand five to six feet tall in a barn that has a ceiling height of six to seven feet.

Second Embodiment

Figure 4:
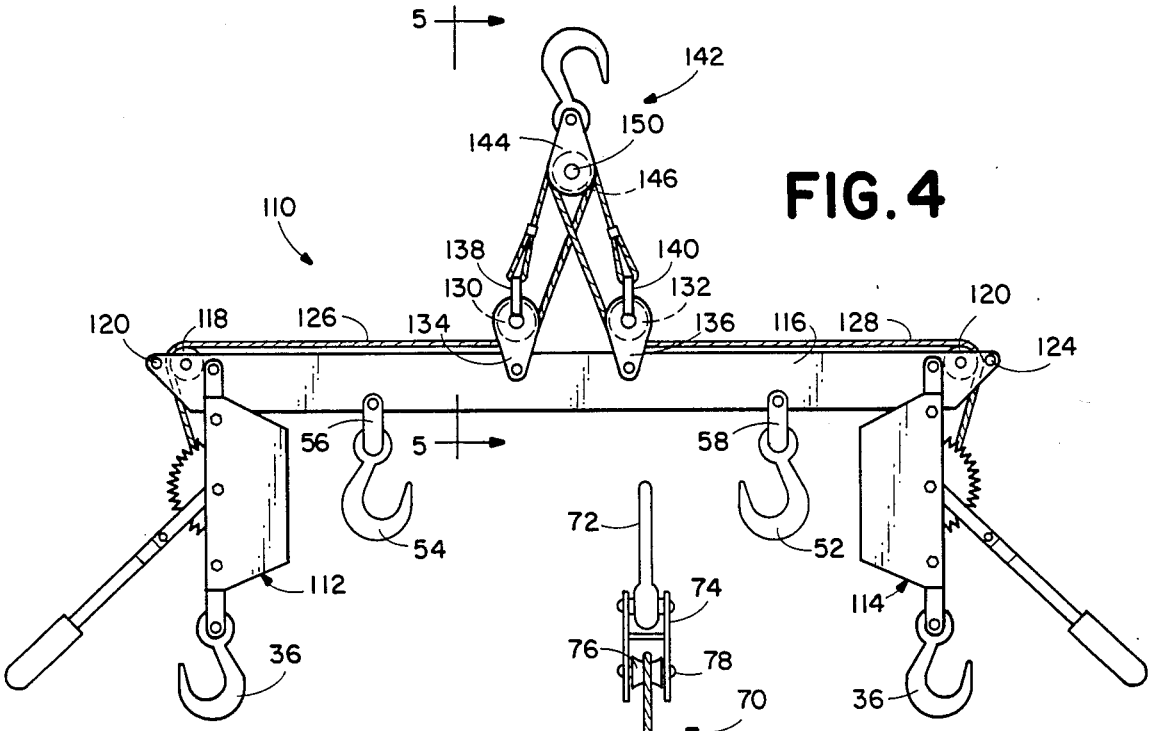
FIG. 4 is a side plan view of a second embodiment of the invention.
Figure 5:
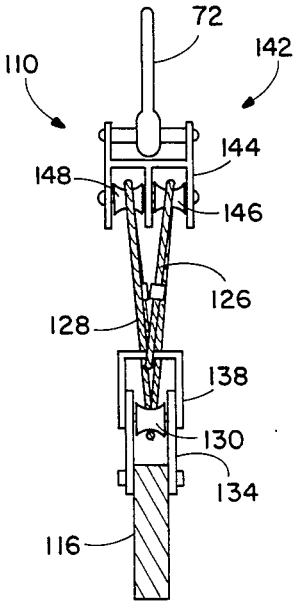
FIG. 5 is an end sectional view of the invention, taken generally along line 5—5 of FIG. 4.

Turning now to FIGS. 4 and 5, the second embodiment of the hoist system of the invention is shown, generally at 110. Certain components which are identical to those in the first embodiment are identified by like numbers. In this embodiment, a winch mechanism or come-along 112, 114, is positioned at either end of an elongate bar 116. Come-alongs 112, 114 are like come-along 32 shown in FIGS. 1–3 and 6. In this embodiment, a slot is formed in both ends of the bar for receiving the terminal pulleys 118, 120. Cable retaining pins 122, 124 are provided to retain the first cable 126 and the second cable 128 in the slots and over the terminal pulleys.

A pair of intermediate pulleys 130, 132 are rotatably mounted in intermediate pulley housings 134, 136, respectively. Each housing has a strap, or cable attachment means 138, 140 attached thereto.

Fastening means 142 in the second embodiment includes a fastening means pulley housing 144 which includes a pair of fastening mean pulleys 146, 148 which are coaxially mounted on an axle 150 which extends through the housing.

Cables 126, 128 are trained, serially, over terminal pulleys 118, 120, intermediate pulleys 130, 132, fastening means pulleys 146, 148 and secured to straps 138, 140, respectively.

Operation

One application of the hoist of the invention is to assist an animal handler in lifting an animal who is down for one reason or another. In order to lift a down animal, the animal is rolled onto its back and its legs are placed through the openings in the sling. The animal is then rolled onto its side and cross members 90 are attached to the sling. Hoist 10 or 110 is secured to an overhead support and sufficient cable is payed out to allow attachment of hooks 30, 36 to eyes 92 on cross members 90 or attachment of hooks 52, 54 of two hoists to eyes 104 or extension straps 106, depending on the height of support 12. The handler adjusts attachment point 88 to the takeup position and operates handle 38 to raise the animal to an upright position.

Once the animal is placed in an upright position, it may be treated and additionally, may be maintained by the hoist and sling in an upright position until it is sufficiently well to support its own weight.

Although the first embodiment has sufficient lifting capacity to handle most domestic animals, the second embodiment is useful for lifting extremely large animals where a single come-along would not have sufficient lifting capacity or where the cable provided does not have sufficient tensile strength to lift the animal. The second embodiment may be used in those situations when dealing with captive wild animals in zoological confines.

Thus, a hoist system has been disclosed which enables an animal handler to lift an animal at multiple points which requires the use of only a single overhead support point. The hoist system is particularly suitable for use in a situation where there is minimal overhead clearance, such as in a lean-to type stall.

Although two preferred embodiments of the invention have been disclosed, it should be appreciated that further variations and modifications may be made thereto without departing from the spirit of the invention.

It is claimed and desired to secure by Letters Patent:

1. In combination with an animal sling and an overhead support, a hoist system for lifting the sling and an animal carried therein comprising:

an elongate bar disposed below the overhead support and extending in a generally horizontal direction, said bar having a terminal pulley at at least one end thereof;

at least one intermediate pulley and a housing therefore, said housing being attached to the top side of said bar intermediate the ends thereof, said intermediate pulley housing having cable attachment means thereon;

fastening means connectable to said overhead support, including at least one downwardly extending fastening means pulley and a housing for said fastening means pulley, said housing having a hook at one end thereof for engaging the overhead support;

said hook, housing for fastening means and housing for intermediate pulley being constructed and arranged to lift an animal carried in the sling with the animal being relatively vertically close to the overhead support;

at least one come-along device mounted outboard of said terminal pulley at one end of said bar and extending downwards from said bar, said come-along including a winch drum and a length of cable having one end attached to said winch drum, the other end of said cable being trained, seriatim, over said terminal pulley, said intermediate pulley, said fastening means pulley and secured to said cable attachment means, said come-along being operable to reel in and pay out said cable, thereby to raise and lower said bar relative to the overhead support; and connecting means for connecting said bar to the sling.

2. The system of claim 1 which further includes a second cable attachment means, a second fastening means pulley, a second intermediate pulley, a second terminal pulley rotatably attached adjacent the other end of said bar, and a second come-along device affixed adjacent said second mentioned terminal pulley, and a second cable attached to said second winch drum and said second cable attachment means, said second cable being trained over the second mentioned pulleys in the manner of the first mentioned cable, said second come-along being constructed and arranged to cooperate with said first come-along to raise and lower said bar.

3. The system of claim 1 which further includes a pair of cross member means constructed and arranged to span an object being lifted, said cross member means being attached between said connecting means and the sling.

* * * * *